US012169109B2

(12) United States Patent
Krnežić

(10) Patent No.: US 12,169,109 B2
(45) Date of Patent: Dec. 17, 2024

(54) FIREARM ACCESSORIES AND ATTACHMENT SYSTEMS

(71) Applicant: HS Produkt D.O.O., Karlovac (HR)

(72) Inventor: Mario Krnežić, Ozalj (HR)

(73) Assignee: HS Produkt D.O.O., Karlovac (HR)

( * ) Notice: Subject to any disclaimer, the term of this patent is extended or adjusted under 35 U.S.C. 154(b) by 0 days.

(21) Appl. No.: 17/651,663

(22) Filed: Feb. 18, 2022

(65) Prior Publication Data

US 2023/0266089 A1 Aug. 24, 2023

(51) Int. Cl.
*F41A 21/32* (2006.01)
*F41A 21/36* (2006.01)

(52) U.S. Cl.
CPC ..... *F41A 21/325* (2013.01); *F41A 21/36* (2013.01)

(58) Field of Classification Search
CPC ..... F41A 21/30–42
USPC ..... 89/14.2–14.4
See application file for complete search history.

(56) References Cited

U.S. PATENT DOCUMENTS 3,202,056 A * 8/1965 Seeberger ..... F41A 21/36 89/14.3
3,710,679 A * 1/1973 Werbell, III ..... F41A 21/30 89/14.4
4,235,152 A * 11/1980 Bekker ..... F41A 21/36 89/14.3
4,374,484 A * 2/1983 Bekker ..... F41A 21/325 89/14.3
4,576,084 A * 3/1986 Brandl ..... F41A 21/30 181/254
4,715,140 A * 12/1987 Rosenwald ..... F41A 3/86 89/14.3

(Continued)

FOREIGN PATENT DOCUMENTS

EP 1 930 684 6/2008
WO WO-2019118995 A1 * 6/2019 ..... F41A 21/325

OTHER PUBLICATIONS

Blog Silencer Shop, Direct Thread, Quick Attach Suppressors, Retrieved Feb. 8, 2022.

(Continued)

*Primary Examiner* — Joshua E Freeman
*Assistant Examiner* — Benjamin S Gomberg
(74) *Attorney, Agent, or Firm* — Woodard, Emhardt, Henry, Reeves & Wagner, LLP

(57) ABSTRACT

A system and method for attaching a muzzle attachment to a firearm. The muzzle attachment has an attachment body that is defined by an inner surface having a bore along the central axis of the muzzle attachment. The attachment body may include a threaded portion extending a length along the inner surface configured to engage a threaded portion of the firearm. The attachment body includes a lock that is configurable from a retracted configuration to an extended configuration. In the extended configuration, the lock is configured to securely engage a recess of the firearm. By threading the muzzle attachment onto the firearm and engaging the lock with the recess, the muzzle attachment system resists removal of the muzzle attachment from the firearm. The muzzle attachment may include vents. The muzzle attachment system preferably is indexed relative to the firearm for proper operation of the muzzle attachment during engagement of the lock.

19 Claims, 11 Drawing Sheets

(56) References Cited

U.S. PATENT DOCUMENTS

| | | | | |
|---|---|---|---|---|
| 4,920,679 | A * | 5/1990 | Sarles | F41A 21/481 42/75.02 |
| 5,050,480 | A * | 9/1991 | Knight, Jr. | F41A 5/06 D22/104 |
| 5,136,924 | A * | 8/1992 | Forster | F41A 21/325 89/14.4 |
| 7,661,349 | B1 * | 2/2010 | Brittingham | F41A 21/30 42/1.06 |
| 7,823,314 | B1 * | 11/2010 | Wheatley | F41A 21/484 89/14.4 |
| 10,508,878 | B1 | 12/2019 | Oglesby | |
| 10,767,952 | B1 * | 9/2020 | Till | F41A 21/325 |
| 10,890,400 | B2 * | 1/2021 | Christandl | F41A 21/325 |
| 11,156,423 | B2 * | 10/2021 | Winterseth | F41A 21/34 |
| 2017/0205178 | A1 * | 7/2017 | Niswander | F41A 21/325 |
| 2018/0058792 | A1 * | 3/2018 | Schirmer | F41A 21/36 |
| 2019/0154388 | A1 * | 5/2019 | Jager | F41G 1/02 |
| 2020/0025501 | A1 * | 1/2020 | Price | F41A 21/36 |
| 2020/0141681 | A1 * | 5/2020 | Na | F41A 21/36 |
| 2023/0228515 | A1 * | 7/2023 | Roe | F41A 21/325 89/14.05 |

OTHER PUBLICATIONS

English Translation of EP 1 930 684 by Gaston Glock, Retrieved Feb. 9, 2022.
Silencer Shop, Dead Air Sandman, Retrieved Feb. 8, 2022.
Silencer Shop, Silencerco Omega 300, Retrieved Feb. 8, 2022.
Silencer Shop, Silencerco Omega 36m, Retrieved Feb. 8, 2022.
Silencer Shop, Surefire Socom 556 RC2, Retrieved Feb. 8, 2022.
YouTube Video, Dead Air Sandman K Review, Retrieved Feb. 8, 2022.
YouTube Video, Warm Armament Resarch's WAR-LOC System, Retrieved Feb. 9, 2022.
YouTube Video, YHM Q.D. Mount Explained, Retrieved Feb. 8, 2022.

* cited by examiner

FIREARM ACCESSORIES AND ATTACHMENT SYSTEMS

FIELD OF THE INVENTION

The present disclosure relates generally to firearms and firearm accessories. In particular aspects, the disclosure relates to attachment systems for attaching firearm accessories to a firearm, including muzzle attachments.

BACKGROUND

Firearms utilize and expel propellant gasses when a bullet is fired. It is known to attach an accessory to a firearm to alter the expulsion of these propellant gases and/or to utilize these propellant gases to the advantage of the shooter. For example, firearm accessories, specifically muzzle attachments, may be attached to a firearm to reduce recoil, reduce muzzle rise, reduce noise in the direction of the shooter, and/or reduce the flash created when the gasses are expelled from the end of the barrel. Muzzle attachments include flash suppressors, flash hiders, muzzle breaks, compensators, suppressors and blast deflectors. Attachment of these devices to a firearm is ordinarily done by threading the device onto the barrel of the firearm.

U.S. Pat. No. 3,202,056 to Seeberger discloses an attachment mechanism for attaching a muzzle break to a firearm. Seeberger discloses a leaf spring fixed within a groove located on a barrel of the firearm. While the muzzle break is being threaded onto the barrel, the leaf spring is depressed until the leaf spring aligns with one of a plurality of slots machined on the muzzle break. The leaf spring can engage a slot to secure the muzzle break to the barrel of the firearm. Simultaneously, threading of the Seeberger muzzle break onto the Seeberger barrel results in fingers coming into contact with an external conical surface of the barrel.

There is a desire, however, for alternative and improved accessories and attachment systems for firearms.

SUMMARY

Various embodiments of the present disclosure include an attachment system for attaching an accessory, such as a muzzle attachment, to a firearm.

Firearms include a barrel, a trigger, and a handle. In some instances, firearms further include a slide and/or a guide rod as found in many semi-automatic pistols. The firearm has a forward end and a rearward end. The forward end of the firearm is located towards the muzzle end of the barrel of the firearm. The rearward end is located opposite the forward end. The handle of the firearm may be near the rearward end. The firearm may include a threaded portion to receive an attachment (e.g., a suppressor, flash hider, muzzle brake, compensator, etc.). The threaded portion of the firearm may be located on the barrel (e.g., at the muzzle end).

The firearm includes a lock receiving portion. The locking receiving portion may include a recess. The locking receiving portion may be located on the barrel of the firearm. The threaded portion of the firearm may be located, at least partially, between the locking receiving portion and a forward end of the firearm (e.g., the muzzle end of the barrel). It is contemplated, however, that the threaded portion of the firearm may have a portion positioned rearward of the locking receiving portion.

The lock receiving portion (e.g., recess) may have a length extending along a bore of the barrel. The lock receiving portion of the firearm may be defined by a first side wall and/or a second side wall each having a length extending along a length of the barrel. The side wall(s) may each have a height measured along a direction from an outer-most surface of the barrel towards the bore of the barrel. The side walls may be parallel to each other along their length. The side walls may be parallel to each other along their height. Alternatively, the side walls may be tapered along their length, their height, and/or both. A forward end of the lock receiving portion (e.g., recess) may be open in the direction of the forward end of the firearm so that a portion of the lock may extend into and engage the lock receiving portion along a direction from the forward end of the firearm.

The muzzle attachment has an attachment body having an inner surface. The inner surface defines a bore extending along a central axis of the muzzle attachment. The bore is of sufficient size to allow passage of a bullet during firing of the firearm and/or to receive a portion of the barrel. The inner surface of the muzzle attachment may include a threaded portion extending along a length of the central axis. The threaded portion of the inner surface of the muzzle attachment may be configured to engage the threaded portion of the firearm. The threaded portion of the inner surface may be configured to engage directly and/or indirectly (e.g., through one or more intermediate members). When the muzzle attachment is in threaded engagement with the firearm, the bore of the muzzle attachment is aligned with the bore of the barrel of the firearm. In instances in which the firearm includes a guide rod, the attachment body of the muzzle attachment may include a recess to receive the guide rod of the firearm at least during operation of the firearm.

The muzzle attachment has a lock. The lock has a first portion configured to engage the lock receiving portion of the firearm. The first portion may engage the lock receiving portion of the firearm directly and/or indirectly (e.g., through one or more intermediate members). The lock may be configurable from a retracted configuration to an extended configuration and/or from an extended configuration to a retracted configuration. The lock may protrude through the inner surface of the attachment body in the extended configuration and/or the retracted configuration. In the retracted configuration, the first portion of the lock may be located a first distance from the central axis of the bore of the muzzle attachment. In the extended configuration, the first portion may be located a second distance from the central axis.

The lock may include a spring. The spring may bias the lock towards the extended configuration. The lock may comprise a pivoting lever that pivots around a pivot point. The pivot point may be a roll pin extending transversely through the lock relative to the central axis of the muzzle attachment. The pivot point may be positioned between the spring and the first position of the lock along the length of the central axis of the muzzle attachment. The lock may comprise a first-class lever, a second-class or a third-class lever. The lock may comprise a pivoting lever, a sliding arm, a detent and/or set screw to name a few non-limiting examples.

A first portion of the lock is configured to engage the first portion of the lock receiving portion (e.g., recess) of the firearm when the lock is in the extended configuration. When the muzzle attachment is attached to the firearm, the lock is configured to engage the lock receiving portion of the firearm so as to resist removal of the muzzle attachment from the firearm. In particular aspects, when the lock is engaged, the muzzle attachment system resists rotation of the muzzle attachment in a first direction relative to the firearm by engagement of the lock with the first side wall of the recess. The muzzle attachment system may resist rotation of the muzzle attachment in a second direction relative to the firearm by engagement of the lock with the second side wall. Accordingly, engagement of the lock of the muzzle attachment with the lock receiving portion of the firearm may resist unthreading and/or further threading of the muzzle attachment to the firearm.

The lock may be any shape sufficient for the first portion of the lock to securely engage the first portion of the lock receiving portion. For example, if the lock receiving portion is tapered along the height of the side wall(s), the lock may have a corresponding (e.g., mating) taper.

Advantageously and preferably, engagement of the lock to the lock receiving portion may index the muzzle attachment relative to the firearm. The muzzle attachment may vent or disperse propellant gases that are expelled when the firearm is discharged via a venting portion. The muzzle attachment system is preferably configured to align muzzle attachments for proper operation of the venting portion, such that the vents expel the propellant gas transversely relative to the central axis. Preferably, engagement of the lock to the lock receiving portion occurs only when a vent of the muzzle attachment is not directed towards the side of the barrel of the trigger and handle (e.g., downward). More preferably, engagement of the lock to the lock receiving portion occurs only when a vent of the muzzle attachment is directed towards a side of the barrel opposite the trigger and handle (e.g., upwards) and/or when vents of the muzzle attachment are directed towards lateral sides of the firearm (e.g., left and right sides).

Preferably, the lock is configured to engage the lock receiving portion after the forward-most portion of the threaded portion of the muzzle attachment is even with or rearward of the muzzle of the barrel relative to the central axis. Preferably, the lock is configured to engage the lock receiving portion when a rearward-facing surface of the muzzle attachment contacts a forward-facing surface of the barrel.

In one exemplary embodiment, the muzzle attachment is a compensator. The central bore of the compensator may include a venting portion located forward of the threaded portion. The venting portion may include one or a plurality of vents for expulsion of the propellant gas. The venting portion may taper outwardly from the central axis along a length of the muzzle attachment towards the forward end. The muzzle attachment system preferably indexes the compensator such that at least one vent is facing a direction opposite the handle and the trigger of the firearm relative to the central axis. For example, the muzzle attachment system may align the vents of the compensator such that propellant gas is discharged in a direction away from a side of the barrel facing the handle and/or trigger of the firearm.

In an exemplary embodiment, the compensator includes three vents, which are located on three different sides of the compensator. The muzzle attachment system may be configured to index the compensator such that none of the vents expel propellant gas in the direction of the trigger and/or handle or in the direction of a side of the barrel facing the trigger and/or handle. In one such configuration, one vent is on the top of the compensator and each of the two remaining vents are on opposite sides of the compensator, with the bottom of the compensator facing the side of the barrel facing the trigger and/or handle.

The compensator may include grooves in the venting portion. The grooves may define a recess in the inner surface of the venting portion of the compensator that taper upwards towards the vents located on either side of the compensator. In this manner, the grooves may be configured to direct the propellant gas at an upward angle. As such, the expelled propellant gas can be directed on a slightly upward trajectory, thus further assisting the compensator to resist muzzle rise that occurs during discharge of the firearm.

A method of attaching an accessory (e.g., muzzle attachment) to a firearm will now be described with reference to the features and embodiments described elsewhere herein. In an optional first stage, the lock of the accessory may be configured from an extended configuration to a retracted configuration. This may be accomplished by, for example, applying a force to a second portion of a lock to move a first portion of a lock arranged for engagement with the firearm. The force on the second portion may depress a spring. In a second stage, the accessory may be brought into engagement with the firearm. For example, a muzzle attachment can be threaded onto a threaded portion of a barrel. In some instances, the optional first and second stages occur simultaneously. In a third stage, the lock is configured into the extended configuration so as to position the first portion of the lock in the lock receiving portion of the firearm. The third stage may occur by, for example, removing force from the second portion of the lock so as to allow the spring to bias the lock into the extended configuration. In the extended configuration, the first portion of the lock can engage the lock receiving portion of the firearm and resist removal of the accessory (e.g., muzzle attachment) from the firearm. For example, the lock may resist rotation of the accessory attachment relative to the firearm (e.g., relative to the barrel). Preferably, in the third stage the muzzle attachment is aligned with the firearm so that the muzzle attachment does not require further adjustment (e.g., rotation) to orient one or more vents of the muzzle attachment relative to the firearm.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
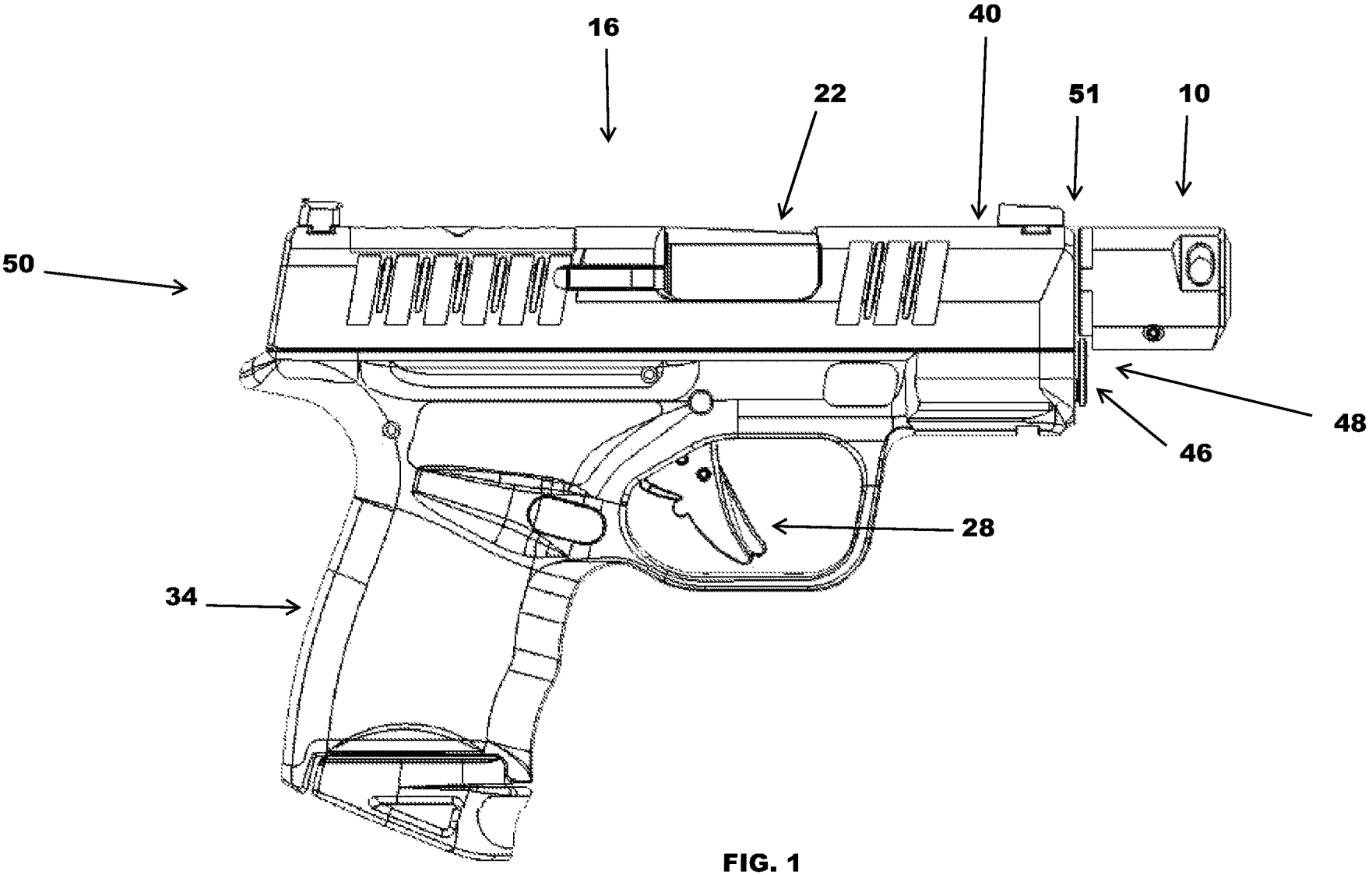
FIG. 1 is a side view of a firearm equipped with an embodiment of a muzzle attachment of the present disclosure.
Figure 2:
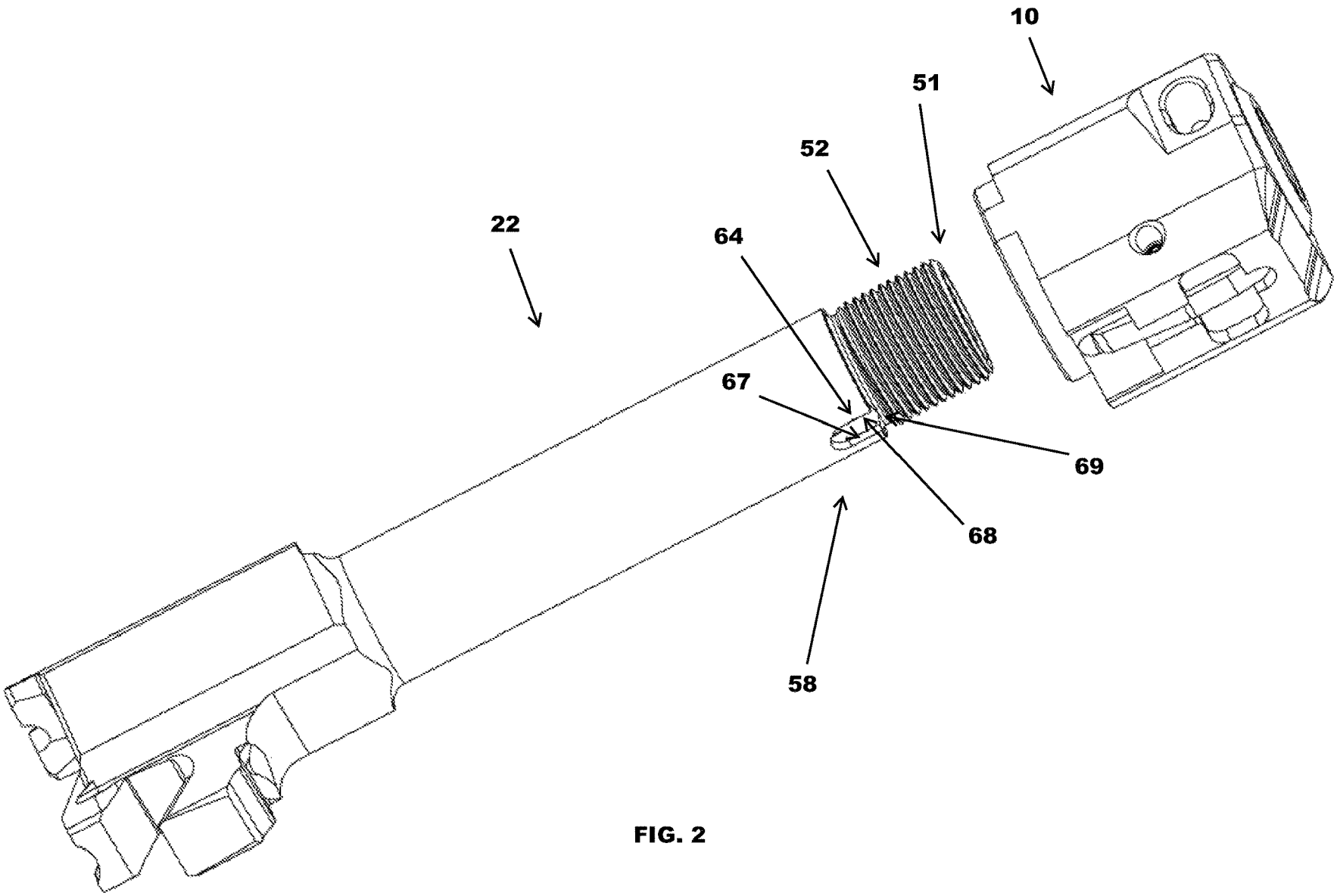
FIG. 2 is a bottom perspective view of a muzzle attachment system.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Various embodiments of the present disclosure include an attachment system for attaching an accessory, such as a muzzle attachment 10, to a firearm 16.

Firearms 16 include a barrel 22, a trigger 28, and a handle 34. In some instances, firearms further include a slide 40 and/or a guide rod 46 as found in many semi-automatic pistols. The firearm has a forward end 48 and a rearward end 50. The forward end of the firearm is located towards the muzzle end 51 of the barrel of the firearm. The rearward end is located opposite the forward end. The handle of the firearm may be near the rearward end. The firearm may include a threaded portion 52 to receive an attachment (e.g., a suppressor, flash hider, muzzle brake, compensator, etc.). The threaded portion of the firearm may be located on the barrel (e.g., at the muzzle end).

The firearm includes a lock receiving portion 58. The locking receiving portion may include a recess 64. The locking receiving portion may be located on the barrel of the firearm. The threaded portion of the firearm may be located, at least partially, between the locking receiving portion and a forward end of the firearm (e.g., the muzzle end of the barrel). It is contemplated, however, that the threaded portion of the firearm may have a portion positioned rearward of the locking receiving portion.

The lock receiving portion (e.g., recess) may have a length extending along a bore 66 of the barrel. The lock receiving portion of the firearm may be defined by a first side wall 67 and/or a second side wall 68 each having a length extending along a length of the barrel. The side wall(s) may each have a height measured along a direction from an outer-most surface of the barrel towards the bore of the barrel. The side walls may be parallel to each other along their length. The side walls may be parallel to each other along their height. Alternatively, the side walls may be tapered along their length, their height, and/or both. A forward end 69 of the lock receiving portion (e.g., recess) may be open in the direction of the forward end of the firearm so that a portion of a lock may extend into and engage the lock receiving portion along a direction from the forward end of the firearm.

The muzzle attachment has an attachment body 70 having an inner surface 76. The inner surface defines a bore 78 extending along a central axis 80 of the muzzle attachment. The bore is of sufficient size to allow passage of a bullet during firing of the firearm and/or to receive a portion of the barrel. The inner surface of the muzzle attachment may include a threaded portion 82 extending along a length of the central axis. The threaded portion of the inner surface of the muzzle attachment may be configured to engage the threaded portion 52 of the firearm. The threaded portion of the inner surface may be configured to engage directly and/or indirectly (e.g., through one or more intermediate members). When the muzzle attachment is in threaded engagement with the firearm, the bore of the muzzle attachment is aligned with the bore of the barrel of the firearm. In instances in which the firearm includes a guide rod, the attachment body of the muzzle attachment may include a recess 88 to receive the guide rod of the firearm at least during operation of the firearm.

Figure 3:
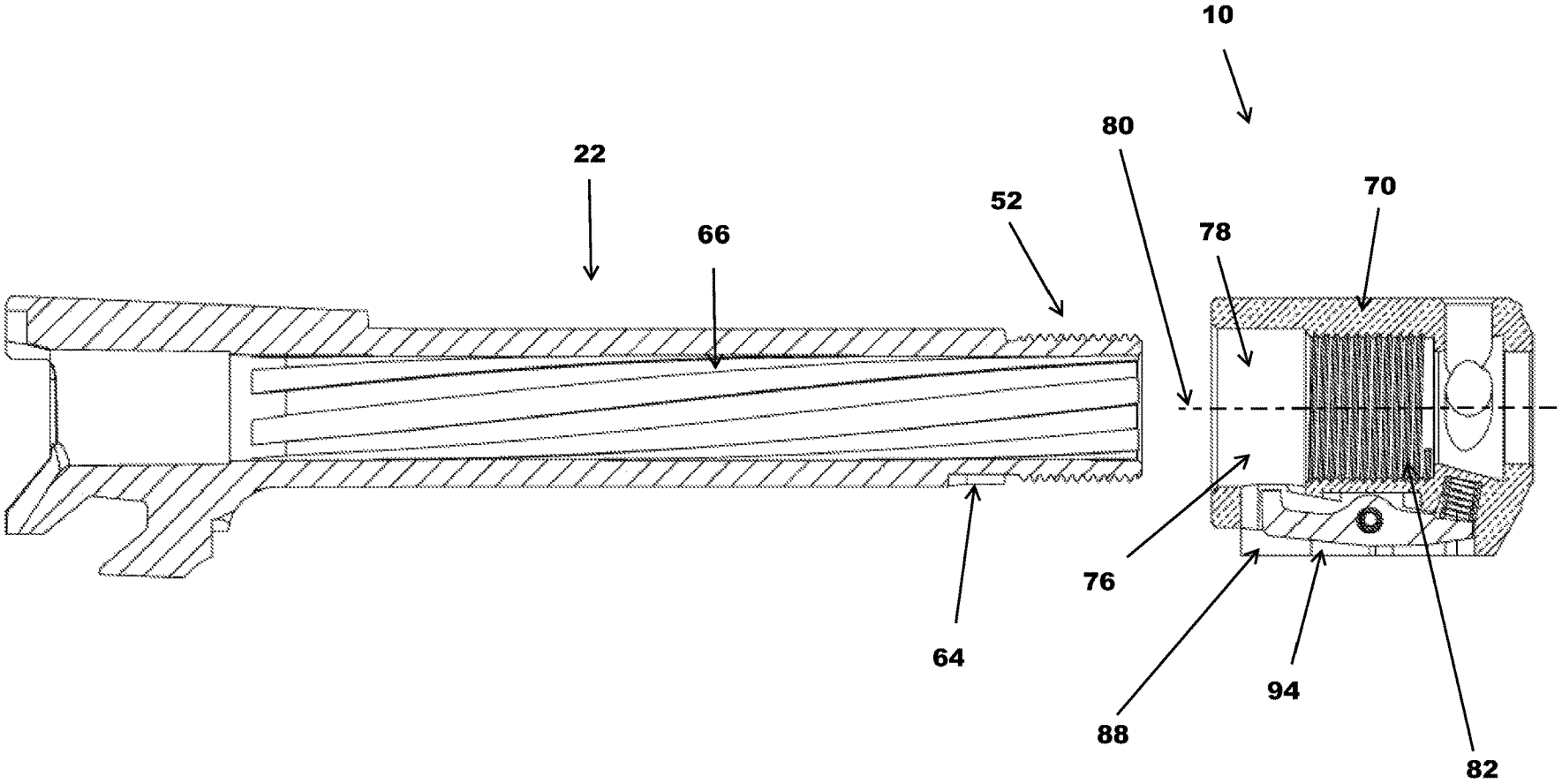
FIG. 3 is a cross-sectional side view of the muzzle attachment system of FIG. 2.
Figure 4:
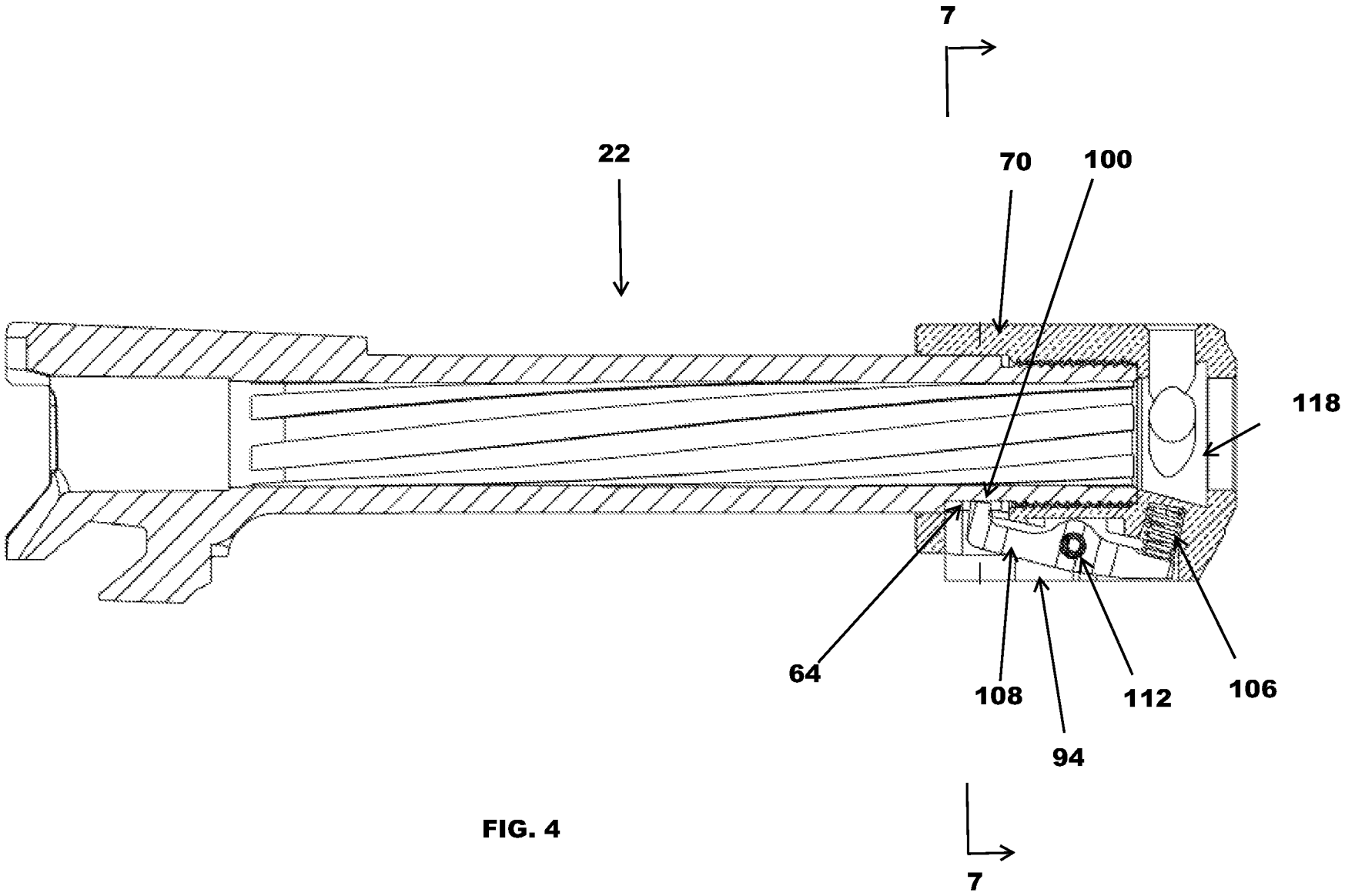
FIG. 4 is a cross-sectional side view of an embodiment of the muzzle attachment system of FIG. 2 with the muzzle attachment positioned on the barrel.
Figure 5:
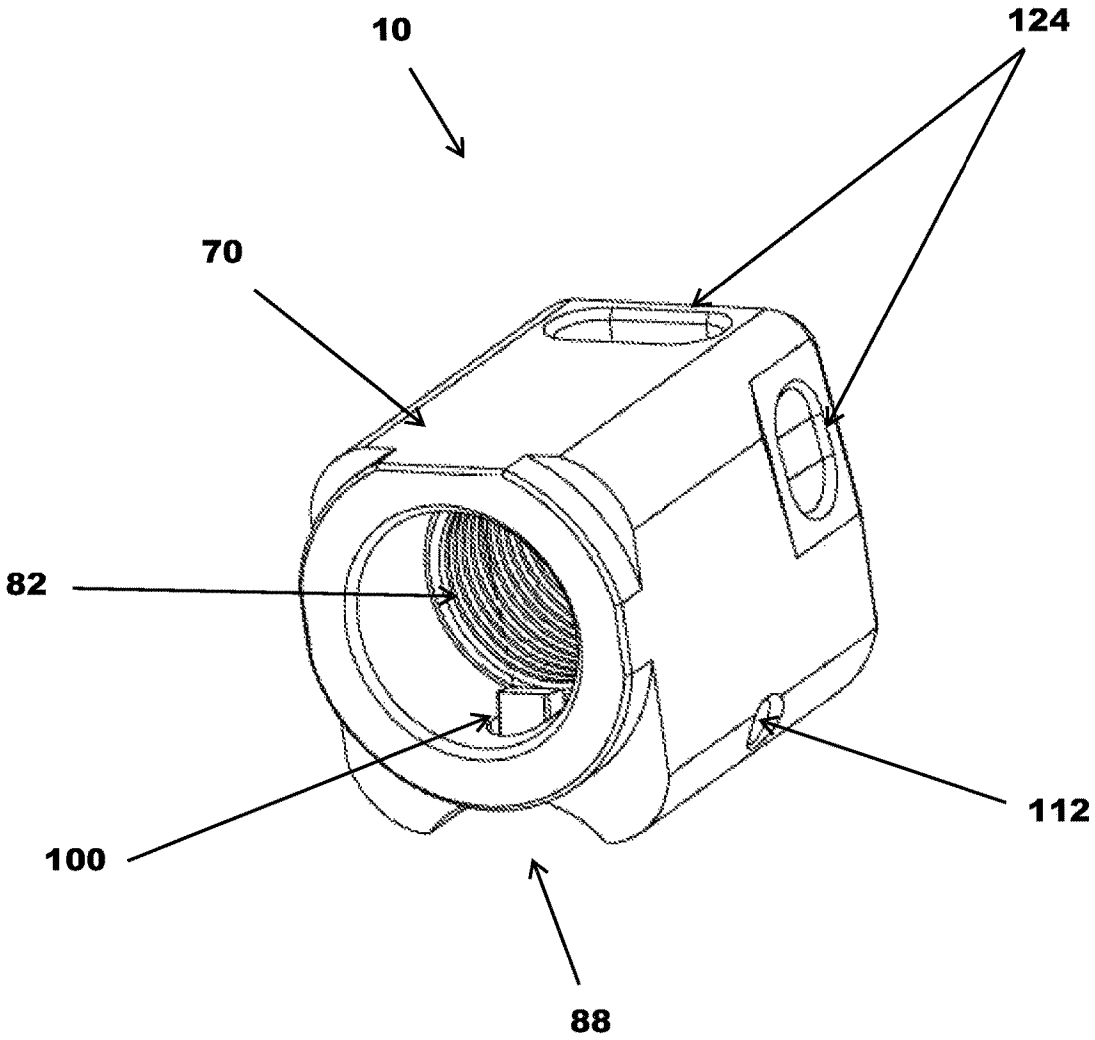
FIG. 5 is a rear perspective view of the muzzle attachment of FIG. 2 in a first condition (e.g., in an extended configuration).
Figure 6:
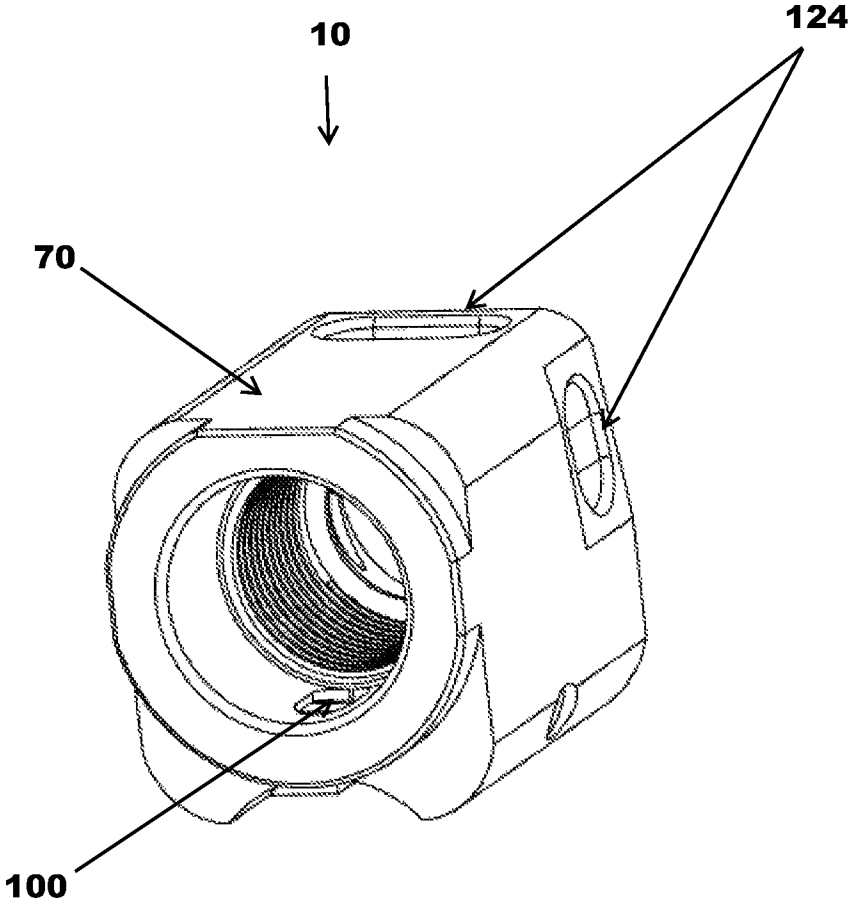
FIG. 6 is a rear perspective view of the muzzle attachment of FIG. 2 in a second condition (e.g., in a retracted configuration).

The muzzle attachment has a lock 94. The lock has a first portion 100 configured to engage the lock receiving portion of the firearm. The first portion may engage the lock receiving portion of the firearm directly and/or indirectly (e.g., through one or more intermediate members). The lock may be configurable from a retracted configuration (example shown in FIGS. 3 and 6) to an extended configuration (example shown in FIGS. 4 and 5) and/or from an extended configuration to a retracted configuration. The lock may protrude through the inner surface of the attachment body in the extended configuration and/or the retracted configuration. In the retracted configuration, the first portion of the lock may be located a first distance from the central axis of the bore of the muzzle attachment. In the extended configuration, the first portion may be located a second distance from the central axis.

The lock may include a spring 106. The spring may bias the lock towards the extended configuration. The lock may comprise a pivoting lever 108 that pivots around a pivot point 112. The pivot point may be a roll pin extending transversely through the lock relative to the central axis of the muzzle attachment. The pivot point may be positioned between the spring and the first position of the lock along the length of the central axis of the muzzle attachment. The lock may comprise a first-class lever, a second-class or a third-class lever. The lock may comprise a pivoting lever, a sliding arm, a detent and/or set screw to name a few non-limiting examples.

Figure 7:
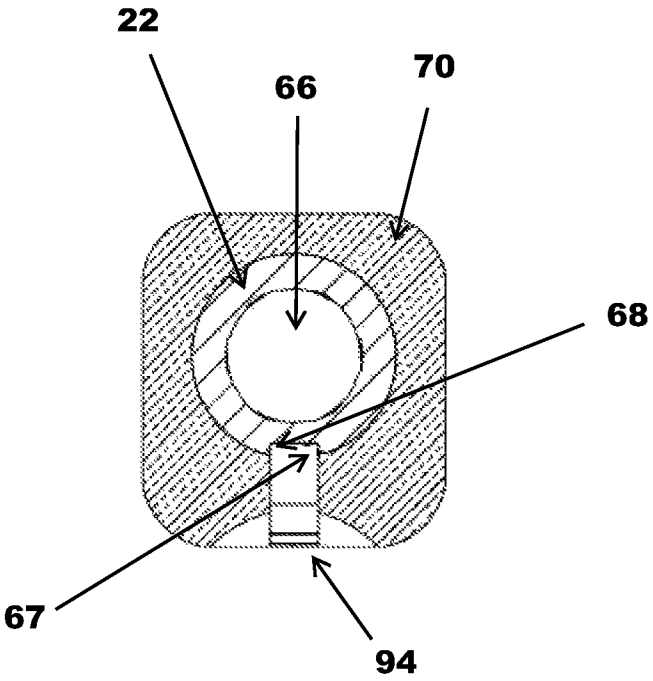
FIG. 7 is a cross-sectional view along line 7-7 of FIG. 4.
Figure 8:
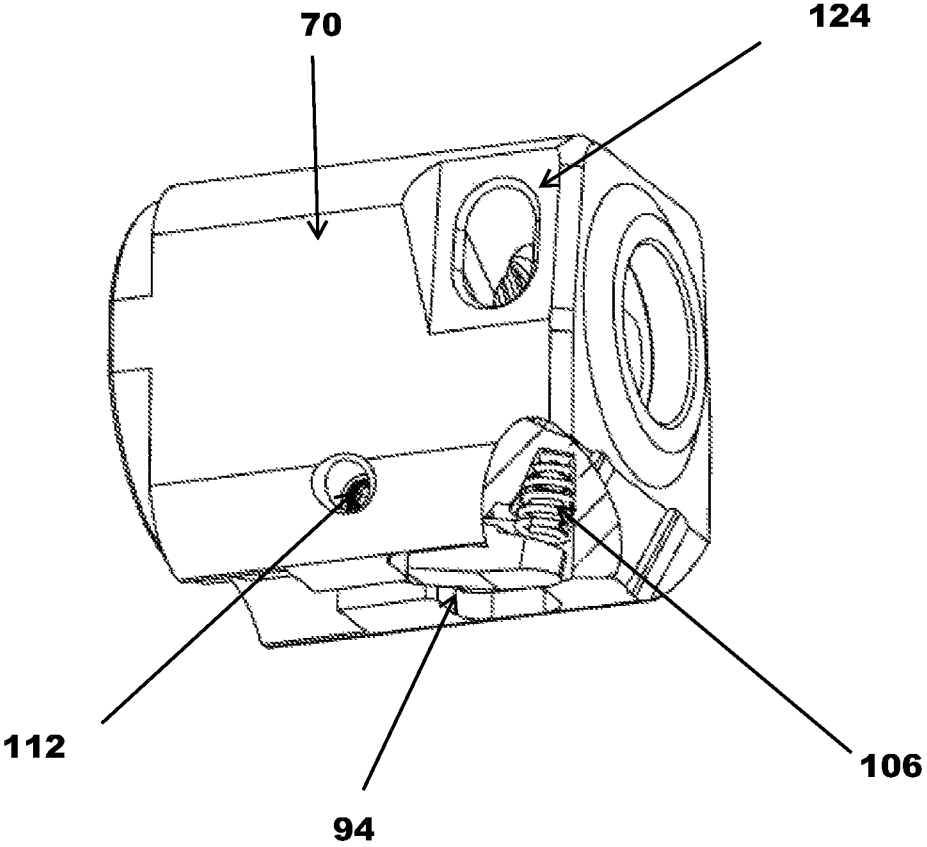
FIG. 8 is a partial cross-sectional of the muzzle attachment of FIG. 2.
Figure 9:
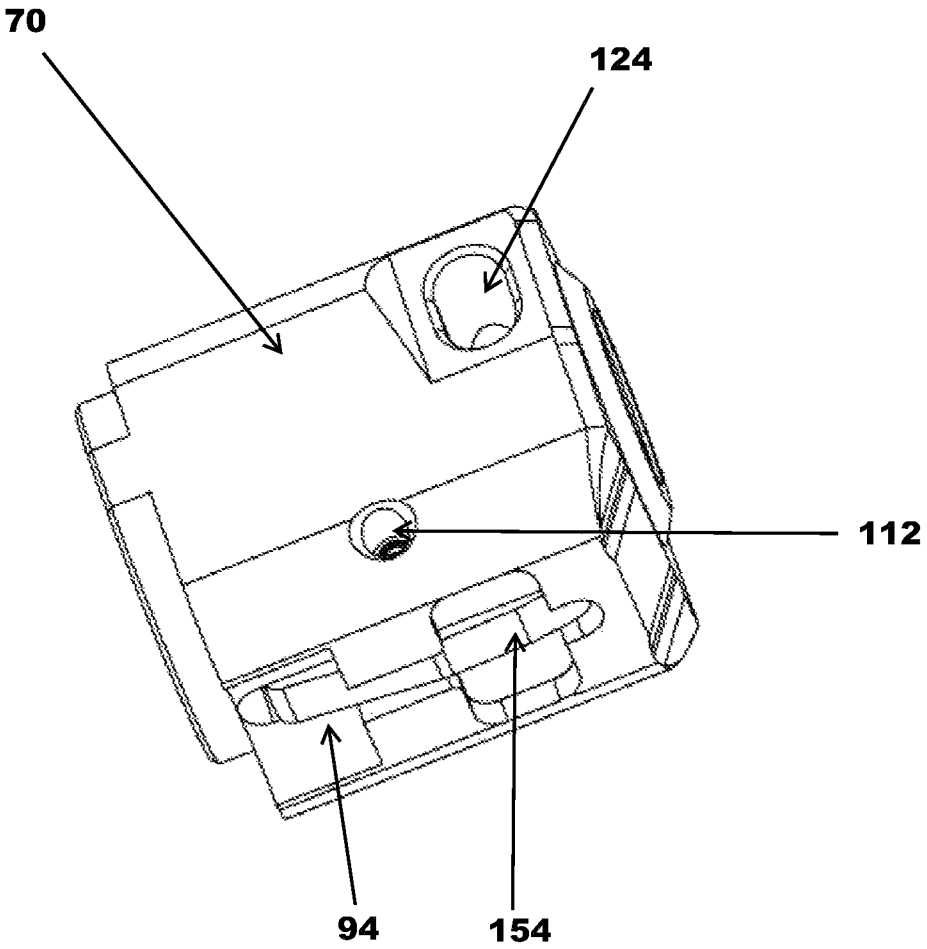
FIG. 9 is a bottom, side perspective view of the muzzle attachment of FIG. 2.

A first portion of the lock is configured to engage the first portion of the lock receiving portion (e.g., recess) of the firearm when the lock is in the extended configuration. When the muzzle attachment is attached to the firearm, the lock is configured to engage the lock receiving portion of the firearm so as to resist removal of the muzzle attachment from the firearm. In particular aspects, when the lock is engaged, the muzzle attachment system resists rotation of the muzzle attachment in a first direction relative to the firearm by engagement of the lock with the first side wall 67 of the recess. The muzzle attachment system may resist rotation of the muzzle attachment in a second direction relative to the firearm by engagement of the lock with the second side wall 68 (see FIG. 7). Accordingly, engagement of the lock of the muzzle attachment with the lock receiving portion of the firearm may resist unthreading and/or further threading of the muzzle attachment to the firearm.

The lock may be any shape sufficient for the first portion of the lock to securely engage the first portion of the lock receiving portion. For example, if the lock receiving portion is tapered along the height of the side wall(s), the lock may have a corresponding (e.g., mating) taper.

Advantageously and preferably, engagement of the lock to the lock receiving portion may index the muzzle attachment relative to the firearm. The muzzle attachment may vent or disperse propellant gases that are expelled when the firearm is discharged via a venting portion 118. The muzzle attachment system is preferably configured to align muzzle attachments for proper operation of the venting portion, such that the vents 124 expel the propellant gas transversely relative to the central axis. Preferably, engagement of the lock to the lock receiving portion occurs only when a vent of the muzzle attachment is not directed towards the side of the barrel of the trigger and handle (e.g., downward). More preferably, engagement of the lock to the lock receiving portion occurs only when a vent of the muzzle attachment is directed towards a side of the barrel opposite the trigger and handle (e.g., upwards) and/or when vents of the muzzle attachment are directed towards lateral sides of the firearm (e.g., left and right sides) as shown in FIG. 1.

Preferably, the lock is configured to engage the lock receiving portion after the forward-most portion of the threaded portion of the muzzle attachment is even with or rearward of the muzzle of the barrel relative to the central axis. Preferably, the lock is configured to engage the lock receiving portion when a rearward-facing surface of the muzzle attachment contacts a forward-facing surface of the barrel.

Figure 10:
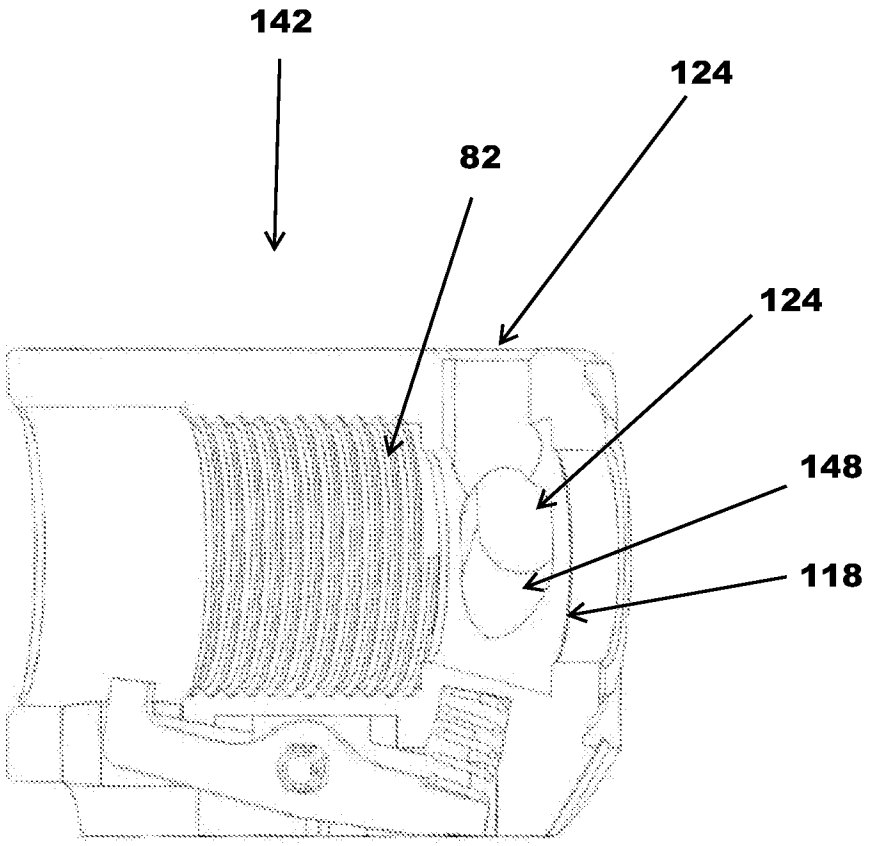
FIG. 10 is a cross-sectional side view of the muzzle attachment of FIG. 2.
Figure 11:
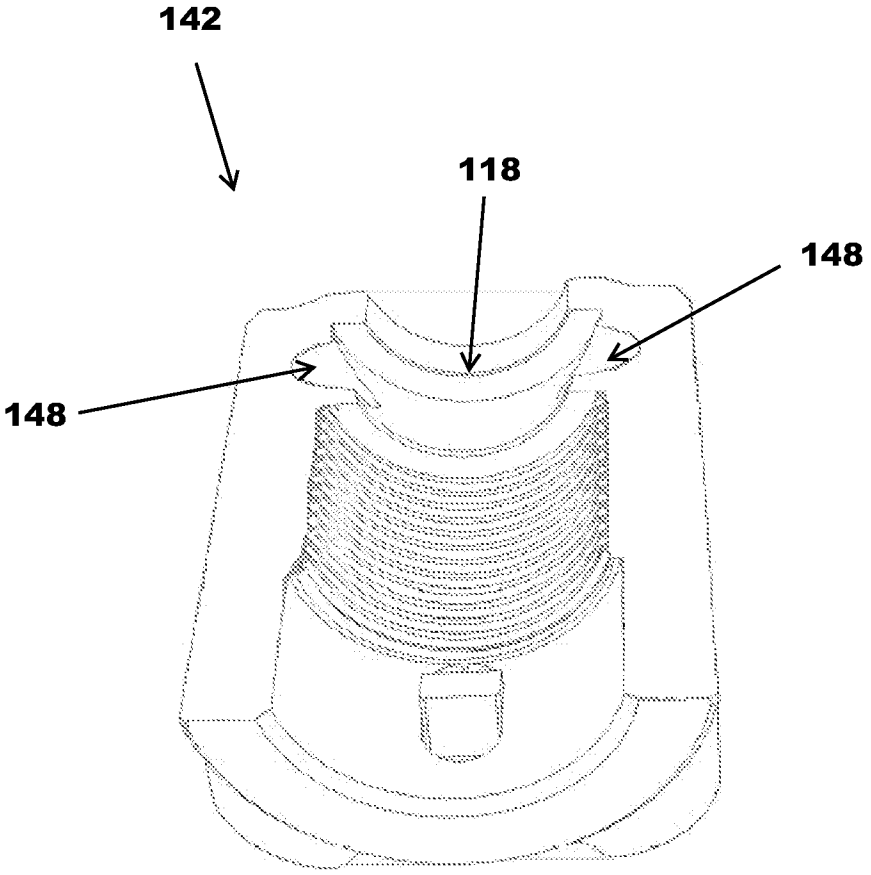
FIG. 11 cross-sectional, top perspective view of the muzzle attachment of FIG. 2.

In one exemplary embodiment, the muzzle attachment is a compensator 142, as illustrated in FIG. 10. The central bore of the compensator may include a venting portion 118 located forward of the threaded portion 82. The venting portion may include one or a plurality of vents 124 for expulsion of the propellant gas. The venting portion may taper outwardly from the central axis along a length of the muzzle attachment towards the forward end. The muzzle attachment system preferably indexes the compensator such that at least one vent is facing a direction opposite the handle and the trigger of the firearm relative to the central axis. For example, the muzzle attachment system may align the vents of the compensator such that propellant gas is discharged in a direction away from a side of the barrel facing the handle and/or trigger of the firearm.

In an exemplary embodiment, the compensator includes three vents, which are located on three different sides of the compensator. The muzzle attachment system may be configured to index the compensator such that none of the vents expel propellant gas in the direction of the trigger and/or handle or in the direction of a side of the barrel facing the trigger and/or handle. In one such configuration, one vent is on the top of the compensator and each of the two remaining vents are on opposite sides of the compensator, with the bottom of the compensator facing the side of the barrel facing the trigger and/or handle.

The compensator may include grooves 148 in the venting portion. The grooves may define a recess in the inner surface of the venting portion of the compensator that taper upwards towards the vents located on either side of the compensator. In this manner, the grooves may be configured to direct the propellant gas at an upward angle. As such, the expelled propellant gas can be directed on a slightly upward trajectory, thus further assisting the compensator to resist muzzle rise that occurs during discharge of the firearm.

A method of attaching an accessory (e.g., muzzle attachment) to a firearm will now be described with reference to the features and embodiments described elsewhere herein. In an optional first stage, the lock of the accessory may be configured from an extended configuration to a retracted configuration. This may be accomplished by, for example, applying a force to a second portion 154 of a lock 94 to move a first portion 100 of a lock arranged for engagement with the firearm. The force on the second portion may depress a spring. In a second stage, the accessory may be brought into engagement with the firearm. For example, a muzzle attachment can be threaded onto a threaded portion of a barrel. In some instances, the optional first and second stages occur simultaneously. In a third stage, the lock is configured into the extended configuration so as to position the first portion of the lock in the lock receiving portion of the firearm. The third stage may occur by, for example, removing force from the second portion of the lock so as to allow the spring to bias the lock into the extended configuration. In the extended configuration, the first portion of the lock can engage the lock receiving portion of the firearm and resist removal of the accessory (e.g., muzzle attachment) from the firearm. For example, the lock may resist rotation of the accessory attachment relative to the firearm (e.g., relative to the barrel). Preferably, in the third stage the muzzle attachment is aligned with the firearm so that the muzzle attachment does not require further adjustment (e.g., rotation) to orient one or more vents of the muzzle attachment relative to the firearm.

The term "firearm" as used herein includes rifles, pistols, shotguns, and muzzle loaders. The term "firearm" includes bolt-action firearms, a semi-automatic firearms, and fully-automatic firearms.

The term "muzzle attachment" as used herein includes suppressors, flash hiders, flash dampeners, flash suppressors, muzzle breaks, compensators, and blast diverters and/or any combination of such.

The term "recess" as used herein includes a groove, divot, slot, dimple, hole, inside corner, and/or an impression.

The following numbered clauses set out specific embodiments that may be useful in to understanding the present invention:

1. A muzzle attachment for a firearm, said muzzle attachment comprising:
   - an attachment body having an inner surface defining a longitudinal bore extending along a central axis of the muzzle attachment;
   - a lock connected to said attachment body and configurable from a retracted configuration to an extended configuration; and
   - a spring biasing the lock towards the extended configuration
   - wherein in the retracted configuration the lock has a first portion positioned a first distance from the central axis;
   - wherein in the extended configuration when the muzzle attachment is attached to the firearm the first portion is positioned a second distance from the central axis and engages a portion of the firearm so as to resist removal of the muzzle attachment from the firearm.

2. The muzzle attachment of clause 1, wherein when the lock is in the extended configuration when the muzzle attachment is attached to the firearm, the lock resists rotation of the attachment body in a first direction relative to the firearm.

3. The muzzle attachment of any preceding clause, wherein when the lock is in the extended configuration when the muzzle attachment is attached to the firearm, the lock resists rotation of the attachment body in a second direction relative to the firearm; and wherein the second direction is opposite the first direction.

4. The muzzle attachment of any preceding clause, wherein the attachment body defines a threaded portion extending along a length of the central axis and configured to engage a threaded portion of the firearm when the muzzle attachment is attached to the firearm.

5. The muzzle attachment of any preceding clause, wherein the threaded portion of the firearm is the barrel.

6. The muzzle attachment of any preceding clause, wherein the barrel defines a recess configured to receive the first portion of the lock when the lock is in the extended configuration.

7. The muzzle attachment of any preceding clause, wherein the threaded portion of the firearm is positioned at least partially between the recess and a muzzle end of the barrel.

8. The muzzle attachment of any preceding clause, wherein the barrel defines only one recess configured to receive the first portion of the lock when the lock is in the extended configuration.

9. The muzzle attachment of clause 1, wherein the lock comprises a pivoting lever that pivots around a pivot point positioned between the spring and the first portion of the lock along the central axis.

10. The muzzle attachment of clause 1, wherein the attachment body defines a recess configured to receive a guide rod of the firearm during firing of the firearm when the muzzle attachment is attached to the firearm.

11. The system of clause 1, wherein the muzzle attachment is a compensator.

12. The system of clause 11, wherein when the lock is in the extended configuration when the muzzle attachment is attached to the firearm at least one vent opening of the compensator is on an opposite side of the central axis than a handle and trigger of the firearm.

13. A system comprising:

a firearm having a trigger, a barrel having a barrel axis, and a muzzle attachment at a muzzle end of the barrel;

the muzzle attachment comprising an attachment body and a lock, the attachment body having an inner surface defining a longitudinal bore extending along a central axis of the muzzle attachment and the lock connected to said attachment body and configurable from a retracted configuration to an extended configuration;

wherein the muzzle attachment defines a vent opening arranged to vent propellant away from the muzzle attachment along a direction transverse to the central axis;

wherein when the lock is in the extended configuration when the muzzle attachment is attached to the firearm the lock resists rotation of the attachment body in a first direction relative to the firearm; and wherein when the lock resists rotation of the attachment body relative to the firearm the muzzle attachment is oriented relative to the firearm such that the vent opening vents propellant away from a side of the barrel that does not face the trigger.

14. The muzzle attachment of clause 13, wherein when the lock is in the extended configuration when the muzzle attachment is attached to the firearm the lock resists rotation of the attachment body in a second direction relative to the firearm; and wherein the second direction is opposite the first direction.

15. The system of clause 14, wherein the muzzle attachment is a compensator and when the lock resists rotation of the attachment body relative to the firearm the vent opening of the compensator is on an opposing side of the barrel than the trigger.

16. The system of clause 14, wherein the lock in the extended configuration is received within a lock receiving slot defined by the firearm; and wherein the lock receiving slot opens towards the muzzle end of the barrel.

17. A method for attaching a muzzle attachment to a muzzle end of a firearm, comprising:

threading a threaded portion of the muzzle attachment to a threaded portion of the firearm;

wherein the muzzle attachment comprises an attachment body and a lock, the attachment body having an inner surface defining a longitudinal bore extending along a central axis of the muzzle attachment and the lock is connected to said attachment body and configurable from a disengaged configuration to an engaged configuration;

wherein the lock resists rotation of the muzzle attachment in at least one direction relative to the firearm when the lock is in the engaged configuration;

wherein the muzzle attachment defines a vent opening arranged to vent propellant away from the muzzle attachment along a direction transverse to the central axis; and engaging the lock of the muzzle attachment when the vent opening is on a side of a barrel of the firearm different than a trigger of the firearm.

18. The method of clause 17, wherein the muzzle attachment is a compensator.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, to patent, or patent application were specifically and individually indicated to be incorporated by reference and set forth in its entirety herein.

The invention claimed is:

1. A muzzle attachment for a firearm, said muzzle attachment comprising:

an attachment body having an inner surface defining a longitudinal bore extending along a central axis of the muzzle attachment, said attachment body having a threaded portion for engaging a threaded portion of the firearm and a vent opening arranged to vent propellant gases away from the longitudinal bore along a direction transverse to the central axis;

a lock mounted to said attachment body and configurable from a retracted configuration to an extended configuration; and a spring biasing the lock towards the extended configuration;

wherein in the retracted configuration the lock has a first portion positioned a first distance from the central axis;

wherein in the extended configuration when the muzzle attachment is attached to the firearm the first portion is positioned a second distance from the central axis and engages a portion of the firearm so as to resist removal of the muzzle attachment from the firearm;

wherein said muzzle attachment has an upper portion and a lower portion relative to the firearm and as defined by a horizontal plane extending along the central axis, said horizontal plane orthogonal to a vertical plane extending through said central axis and a trigger of the firearm; and wherein the vent opening of the muzzle attachment is on the upper portion and the lock is on the lower portion.

2. The muzzle attachment of claim 1, wherein the lock comprises a pivoting lever that pivots around a pivot point positioned between the spring and the first portion of the lock along the central axis.

3. The muzzle attachment of claim 1, wherein the attachment body defines a recess configured to receive a guide rod of the firearm during firing of the firearm when the muzzle attachment is attached to the firearm.

4. The muzzle attachment of claim 1, wherein the muzzle attachment is a compensator.

5. The muzzle attachment of claim 1, wherein when the lock is in the extended configuration and the muzzle attachment is attached to the firearm, the lock resists rotation of the attachment body in a first direction relative to the firearm.

6. The muzzle attachment of claim 5, wherein when the lock is in the extended configuration and the muzzle attachment is attached to the firearm, the lock resists rotation of the attachment body in a second direction relative to the firearm; and wherein the second direction is opposite the first direction.

7. The muzzle attachment of claim 6, wherein the threaded portion of the attachment body extends along a length of the central axis and is configured to engage the threaded portion of the firearm when the muzzle attachment is attached to the firearm.

8. The muzzle attachment of claim 7, wherein the threaded portion of the firearm is on a barrel of the firearm.

9. The muzzle attachment of claim 8, wherein the barrel defines a recess configured to receive the first portion of the lock when the lock is in the extended configuration.

10. The muzzle attachment of claim 9, wherein the threaded portion of the firearm is positioned at least partially between the recess and a muzzle end of the barrel.

11. The muzzle attachment of claim 8, wherein the barrel defines only one recess configured to receive the first portion of the lock when the lock is in the extended configuration.

12. The muzzle attachment of claim 1, wherein when the lock is in the extended configuration and the muzzle attachment is attached to the firearm, the lock resists rotation of the attachment body in a first direction relative to the firearm; and wherein said lock is configurable into said extended configuration to resist removal of the muzzle attachment from the firearm prior to the attachment body reaching an end of rotation onto the threaded portion of the firearm.

13. A system comprising:

a firearm having a trigger, a barrel having a barrel axis, and a muzzle attachment at attached to a muzzle end of the barrel;

the muzzle attachment comprising an attachment body and a lock, the attachment body having an inner surface defining a longitudinal bore extending along a central axis of the muzzle attachment and the lock mounted to said attachment body and configurable from a retracted configuration to an extended configuration;

wherein the muzzle attachment defines a vent opening arranged to vent propellant away from the muzzle attachment along a direction transverse to the central axis;

wherein when the lock is in the extended configuration the lock resists rotation of the attachment body in a first direction relative to the firearm; and wherein when the lock resists rotation of the attachment body relative to the firearm the muzzle attachment is oriented relative to the firearm such that the vent opening vents the propellant away from a side of the barrel that does not face the trigger and the lock is on a side of the barrel facing the trigger;

wherein the lock is positioned in plane with the barrel axis and the trigger;

wherein said attachment body has a threaded portion for engaging a threaded portion of the barrel; and wherein said lock is configurable into said extended configuration to resist rotation of the attachment body in said first direction prior to the attachment body reaching an end of rotation onto the threaded portion of the barrel.

14. The system of claim 13, wherein when the lock is in the extended configuration the lock resists rotation of the attachment body in a second direction relative to the firearm; and wherein the second direction is opposite the first direction.

15. The system of claim 14, wherein the muzzle attachment is a compensator and when the lock resists rotation of the attachment body relative to the firearm the vent opening of the compensator is on an opposing side of the barrel than the trigger.

16. The system of claim 14, wherein the lock in the extended configuration is received within a lock receiving slot defined by the firearm; and wherein the lock receiving slot opens towards the muzzle end of the barrel.

17. A method for attaching a muzzle attachment to a muzzle end of a firearm, comprising:

threading a threaded portion of the muzzle attachment to a threaded portion of the firearm; wherein the muzzle attachment comprises an attachment body and a lock, the attachment body having an inner surface defining a longitudinal bore extending along a central axis of the muzzle attachment and the lock is mounted to said attachment body and configurable from a disengaged configuration to an engaged configuration;

wherein the lock resists rotation of the muzzle attachment in at least one direction relative to the firearm when the lock is in the engaged configuration;

wherein the muzzle attachment defines a vent opening arranged to vent propellant away from the muzzle attachment along a direction transverse to the central axis; and engaging the lock of the muzzle attachment when the vent opening is positioned to vent the propellant away from an upper side of a barrel of the firearm and when the lock is on an opposite, trigger side of the barrel as defined by a horizontal plane extending along the central axis, said horizontal plane orthogonal to a vertical plane extending through said central axis and a trigger of the firearm.

18. The method of claim 17, wherein the muzzle attachment is a compensator.

19. The method of claim 17, wherein said engaging the lock of the muzzle attachment occurs prior to the muzzle attachment reaching an end of rotation onto the threaded portion of the firearm.

* * * * *